US006937206B2

(12) United States Patent
Puente Baliarda et al.

(10) Patent No.: US 6,937,206 B2
(45) Date of Patent: Aug. 30, 2005

(54) DUAL-BAND DUAL-POLARIZED ANTENNA ARRAY

(75) Inventors: Carles Puente Baliarda, Barcelona (ES); Jaime Anguera Pros, Vinaros (ES); Carmen Borja Borau, Barcelona (ES)

(73) Assignee: Fractus, S.A., Sant Cugat del Valles (ES)

( * ) Notice: Subject to any disclaimer, the term of this patent is extended or adjusted under 35 U.S.C. 154(b) by 58 days.

(21) Appl. No.: 10/686,223

(22) Filed: Oct. 15, 2003

(65) Prior Publication Data

US 2004/0145526 A1 Jul. 29, 2004

Related U.S. Application Data

(63) Continuation of application No. PCT/EP01/04288, filed on Apr. 16, 2001.

(51) Int. Cl.[7] ..... H01Q 21/00
(52) U.S. Cl. ..... 343/853; 343/700 MS
(58) Field of Search ..... 343/853, 844, 343/983, 700 MS, 770

(56) References Cited

U.S. PATENT DOCUMENTS

| | | | |
|---|---|---|---|
| 3,521,284 | A | 7/1970 | Shelton, Jr. et al. |
| 3,599,214 | A | 8/1971 | Altmayer |
| 3,622,890 | A | 11/1971 | Fujimoto et al. |
| 3,683,376 | A | 8/1972 | Pronovost |
| 3,818,490 | A | 6/1974 | Leahy |

(Continued)

FOREIGN PATENT DOCUMENTS

| | | |
|---|---|---|
| DE | 3337941 | 5/1985 |
| EP | 0096847 | 12/1983 |
| EP | 0297813 | 6/1988 |
| EP | 0358090 | 8/1989 |
| EP | 0543645 | 5/1993 |

(Continued)

OTHER PUBLICATIONS

Ali, M. et al., "A Triple–Band Internal Antenna for Mobile Hand–held Terminals," IEEE, pp. 32–35 (1992).

Romeu, Jordi et al., "A Three Dimensional Hilbert Antenna," IEEE, pp. 550–553 (2002).

Parker et al., "Convoluted array elements and reduced size unit cells for frequency–selective surfaces," IEEE Proceedings H, vol. 138, No. pp. 19–22 (Feb. 1991).

Hansen, R.C., "Fundamental Limitations in Antennas," Proceedings of the IEEE, vol. 69, No. 2, pp. 170–182 (Feb. 1981).

Jaggard, Dwight L., "Fractal Electrodynamics and Modeling," Directions in Electromagnetic Wave Modeling, pp. 435–446 (1991).

Hohlfeld, Robert G. et al., "Self–Similarity and the Geometric Requirements for Frequency Independence in Antennae," Fractals, vol. 7, No. 1, pp. 79–84 (1999).

(Continued)

*Primary Examiner*—Hoang V. Nguyen
*Assistant Examiner*—Huedung X. Cao
(74) *Attorney, Agent, or Firm*—Jones Day

(57) ABSTRACT

The present invention refers generally to a new family of antenna arrays that are able to operate simultaneously at two different frequency bands, while featuring dual-polarization at both bands. The design is suitable for applications where the two bands are centered at two frequencies f1 and f2 such that the ratio between the larger frequency (f2) to the smaller frequency (f1) is f2/f1<1.5. The dual-band dual-polarization feature is achieved mainly by means of the physical position of the antenna elements within the array. Also, some particular antenna elements are newly disclosed to enhance the antenna performance.

11 Claims, 6 Drawing Sheets

U.S. PATENT DOCUMENTS 3,967,276 A 6/1976 Goubau
3,969,730 A 7/1976 Fuchser
4,024,542 A 5/1977 Ikawa et al.
4,131,893 A 12/1978 Munson et al.
4,141,016 A 2/1979 Nelson
4,471,358 A 9/1984 Glasser
4,471,493 A 9/1984 Schober
4,504,834 A 3/1985 Garay et al.
4,543,581 A 9/1985 Nemet
4,571,595 A 2/1986 Phillips et al.
4,584,709 A 4/1986 Kneisel et al.
4,590,614 A 5/1986 Erat
4,623,894 A 11/1986 Lee et al.
4,673,948 A 6/1987 Kuo
4,730,195 A 3/1988 Phillips et al.
4,733,244 A * 3/1988 Edenhofer et al. ..... 343/756
4,839,660 A 6/1989 Hadzoglou
4,843,468 A 6/1989 Drewery
4,847,629 A 7/1989 Shimazaki
4,849,766 A 7/1989 Inaba et al.
4,857,939 A 8/1989 Shimazaki
4,890,114 A 12/1989 Egashira
4,894,663 A 1/1990 Urbish et al.
4,907,011 A 3/1990 Kuo
4,912,481 A 3/1990 Mace et al.
4,975,711 A 12/1990 Lee
5,030,963 A 7/1991 Tadama
5,138,328 A 8/1992 Zibrik et al.
5,168,472 A 12/1992 Lockwood
5,172,084 A 12/1992 Fiedzuiszko et al.
5,200,756 A 4/1993 Feller
5,214,434 A 5/1993 Hsu
5,218,370 A 6/1993 Blaese
5,227,804 A 7/1993 Oda
5,227,808 A 7/1993 Davis
5,245,350 A 9/1993 Sroka
5,248,988 A 9/1993 Makino
5,255,002 A 10/1993 Day
5,257,032 A 10/1993 Diamond et al.
5,347,291 A 9/1994 Moore
5,355,144 A 10/1994 Walton et al.
5,355,318 A 10/1994 Dionnet et al.
5,373,300 A 12/1994 Jenness et al.
5,402,134 A 3/1995 Miller et al.
5,420,599 A 5/1995 Erkocevic
5,422,651 A 6/1995 Chang
5,451,965 A 9/1995 Matsumoto
5,451,968 A 9/1995 Emery
5,453,751 A 9/1995 Tsukamoto et al. .. 343/700 MS
5,457,469 A 10/1995 Diamond et al.
5,471,224 A 11/1995 Barkeshli
5,493,702 A 2/1996 Crowley et al.
5,495,261 A 2/1996 Baker et al. ..... 343/846
5,534,877 A 7/1996 Sorbello et al. ..... 343/700 MS
5,537,367 A 7/1996 Lockwood et al.
H1631 H 2/1997 Montgomery et al.
5,619,205 A 4/1997 Johnson
5,684,672 A 11/1997 Karidis et al.
5,712,640 A 1/1998 Andou et al.
5,714,937 A * 2/1998 Campana, Jr. ..... 340/573.1
5,767,811 A 6/1998 Mandai et al.
5,798,688 A 8/1998 Schofield
5,821,907 A 10/1998 Zhu et al.
5,841,403 A 11/1998 West
5,870,066 A 2/1999 Asakura et al.
5,872,546 A 2/1999 Ihara et al.
5,898,404 A 4/1999 Jou
5,903,240 A 5/1999 Kawahata et al.
5,926,141 A 7/1999 Lindenmeier et al.
5,943,020 A 8/1999 Liebendoerfer et al.
5,966,098 A 10/1999 Qi et al.
5,973,651 A 10/1999 Suesada et al.
5,986,610 A 11/1999 Miron
5,990,838 A 11/1999 Burns et al.
6,002,367 A 12/1999 Engblom et al.
6,025,812 A * 2/2000 Gabriel et al. ..... 343/797
6,028,568 A 2/2000 Asakura et al.
6,031,499 A 2/2000 Dichter
6,031,505 A 2/2000 Qi et al.
6,078,294 A 6/2000 Mitarai
6,091,365 A 7/2000 Derneryd et al. .... 343/700 MS
6,097,345 A 8/2000 Walton
6,104,349 A 8/2000 Cohen
6,127,977 A 10/2000 Cohen
6,131,042 A 10/2000 Lee et al.
6,140,969 A 10/2000 Lindenmeier et al.
6,140,975 A 10/2000 Cohen
6,160,513 A 12/2000 Davidson et al.
6,172,618 B1 1/2001 Hakozaki et al.
6,175,333 B1 1/2001 Smith
6,191,751 B1 * 2/2001 Johnson ..... 343/834
6,211,824 B1 4/2001 Holden et al. ..... 343/700 MS
6,211,841 B1 4/2001 Smith
6,218,992 B1 4/2001 Sadler et al.
6,236,372 B1 5/2001 Lindenmeier et al.
6,266,023 B1 7/2001 Nagy et al.
6,281,846 B1 8/2001 Puente Baliarda et al.
6,307,511 B1 10/2001 Ying et al.
6,329,951 B1 12/2001 Wen et al.
6,329,954 B1 12/2001 Fuchs et al.
6,337,628 B2 * 1/2002 Campana, Jr. ..... 340/573.4
6,367,939 B1 4/2002 Carter et al.
6,407,710 B2 6/2002 Keilen et al.
6,417,810 B1 7/2002 Huels et al.
6,431,712 B1 8/2002 Turnbull
6,445,352 B1 9/2002 Cohen
6,452,549 B1 9/2002 Lo
6,452,553 B1 9/2002 Cohen
6,456,249 B1 * 9/2002 Johnson et al. ..... 343/702
6,476,766 B1 11/2002 Cohen
6,525,691 B2 2/2003 Varadan et al.
6,552,690 B2 4/2003 Veerasamy
2002/0000940 A1 1/2002 Moren et al.
2002/0000942 A1 1/2002 Duroux
2002/0036594 A1 3/2002 Gyenes
2002/0070902 A1 * 6/2002 Johnson et al. ..... 343/702
2002/0105468 A1 8/2002 Tessier et al.
2002/0109633 A1 8/2002 Ow et al.
2002/0126054 A1 9/2002 Fuerst et al.
2002/0126055 A1 9/2002 Lindenmeier et al.
2002/0175866 A1 11/2002 Gram
2003/0090431 A1 5/2003 Gottl
2003/0137456 A1 7/2003 Sreenivas
2004/0108956 A1 6/2004 Gottl

FOREIGN PATENT DOCUMENTS

EP 0571124 11/1993
EP 0688040 12/1995
EP 0765001 3/1997
EP 0814536 12/1997
EP 0871238 10/1998
EP 0892459 1/1999
EP 0929121 7/1999
EP 0932219 7/1999
EP 0969375 1/2000
EP 0986130 3/2000
EP 0942488 4/2000
EP 0997974 5/2000
EP 1018777 7/2000
EP 1018779 7/2000
EP 1071161 1/2001

| | | |
|---|---|---|
| EP | 1079462 | 2/2001 |
| EP | 1083624 | 3/2001 |
| EP | 1094545 | 4/2001 |
| EP | 1096602 | 5/2001 |
| EP | 1148581 | 10/2001 |
| EP | 1198027 | 4/2002 |
| EP | 1237224 | 9/2002 |
| EP | 1267438 | 12/2002 |
| ES | 2112163 | 3/1998 |
| ES | 2142280 | 5/1998 |
| FR | 2543744 | 10/1984 |
| FR | 2704359 | 10/1994 |
| GB | 2215136 | 9/1989 |
| GB | 2330951 | 5/1999 |
| GB | 2355116 | 4/2001 |
| JP | 55147806 | 11/1980 |
| JP | 5007109 | 1/1993 |
| JP | 5129816 | 5/1993 |
| JP | 5267916 | 10/1993 |
| JP | 5347507 | 12/1993 |
| JP | 6204908 | 7/1994 |
| JP | 10209744 | 8/1998 |
| WO | 9511530 | 4/1995 |
| WO | 9627219 | 9/1996 |
| WO | 9629755 | 9/1996 |
| WO | 9638881 | 12/1996 |
| WO | 9706578 | 2/1997 |
| WO | 9711507 | 3/1997 |
| WO | 9732355 | 9/1997 |
| WO | 9733338 | 9/1997 |
| WO | 9735360 | 9/1997 |
| WO | 9747054 | 12/1997 |
| WO | 9812771 | 3/1998 |
| WO | 9836469 | 8/1998 |
| WO | 9903166 | 1/1999 |
| WO | 9903167 | 1/1999 |
| WO | 9925042 | 5/1999 |
| WO | 9927608 | 6/1999 |
| WO | 9956345 | 11/1999 |
| WO | 0001028 | 1/2000 |
| WO | 0003453 | 1/2000 |
| WO | 0022695 | 4/2000 |
| WO | 0036700 | 6/2000 |
| WO | 0049680 | 8/2000 |
| WO | 0052784 | 9/2000 |
| WO | 0052787 | 9/2000 |
| WO | 0103238 | 1/2001 |
| WO | 0108257 | 2/2001 |
| WO | 0113464 | 2/2001 |
| WO | 0117064 | 3/2001 |
| WO | 0122528 | 3/2001 |
| WO | 0124314 | 4/2001 |
| WO | 0126182 | 4/2001 |
| WO | 0128035 | 4/2001 |
| WO | 0131739 | 5/2001 |
| WO | 0133665 | 5/2001 |
| WO | 0135491 | 5/2001 |
| WO | 0137369 | 5/2001 |
| WO | 0137370 | 5/2001 |
| WO | 0141252 | 6/2001 |
| WO | 0148861 | 7/2001 |
| WO | 0154225 | 7/2001 |
| WO | 0173890 | 10/2001 |
| WO | 0178192 | 10/2001 |
| WO | 0182410 | 11/2001 |
| WO | 0235646 | 5/2002 |
| WO | 02091518 | 11/2002 |
| WO | 02096166 | 11/2002 |

OTHER PUBLICATIONS

Samavati, Hirad, et al., "Fractal Capacitors," IEEE Journal of Solid–State Circuits, vol. 33, No. 12, pp. 2035–2041 (Dec. 1998).

Pribeitch, P., et al., "Quasifractal Planar Microstrip Resonators for Microwave Circuits," Microwave and Optical Technology Letters, vol. 21, No. 6, pp. 433–436 (Jun. 20, 1999).

Zhang, Dawei, et al., "Narrowban Lumped–Element Microstrip Filters Using Capacitively–Loaded Inductors," IEEE MTT–S Microwave Symposium Digest, pp. 379–382, (May 16, 1995).

Gough, C.E., et al., "High Tc coplanar resonators for microwave applications and scientific studies," Physica C, NL,North–Holland Publishing, Amsterdam, vol. 282–287, No. 2001, pp. 395–398 (Aug. 1. 1997).

Radio Engineering Reference–Book by H. Meinke and F.V. Gundlah, vol. 1, Radio components, Circuits with lumped parameters. Transmission lines. Wave–guides. Resonators. Arrays. Radio waves propagation, States Energy Publishing House, Moscow, with English translation (1961) [4 pp. 1].

V.A. Volgov, "Parts and Units of Radio Electronic Equipment (Design & Computation)," Energiya, Moscow, with English translation (1967) [4 pp.].

Puente, C., et al., "Multiband properties of a fractal tree antenna generated by electrochemical deposition," Electronics Letters, IEE Stevenage, GB, vol. 32, No. 25, pp. 2298–2299 (Dec. 5, 1996).

Puente, C., et al., "Small but long Koch fractal monopole," Electronics Letters, IEE Stevenage, GB, vol. 34, No. 1, pp. 9–10 (Jan. 8, 1998).

Puente Baliarda, Carles, et al., "The Koch Monopole: A Small Fractal Antenna," IEEE Transactions on Antennas and Propagation, New York, US, vol. 48, No. 11, pp. 1773–1781 (Nov. 1, 2000).

Cohen, Nathan, "Fractal Antenna Applications in Wireless Telecommunications," Electronics Industries Forum of New England, 1997. Professional Program Proceedings Boston, MA US, May 6–8, 1997, New York, NY US, IEEE, US pp. 43–49 (May 6, 1997).

Anguera, J. et al., "Miniature Wideband Stacked Microstrip Patch Antenna Based on the Sierpinski Fractal Geometry," IEEE Antennas and Propagation Society International Symposium, 2000 Digest, Aps., vol. 3 of 4, pp. 1700–1703 (Jul. 16, 2000).

Hara Prasad, R.V., et al., "Microstrip Fractal Patch Antennas for Multi–Band Communication," Electronics Letters, IEE Stevenage, GB, vol. 36, No. 14, pp. 1179–1180 (Jul. 6, 2000).

Borja, C. et al., "High Directivity Fractal Boundary Microstrip Patch Antenna," Electronics Letters. IEE Stevenage, GB, vol. 36, No. 9, pp. 778–779 (Apr. 27, 2000).

Sanad, Mohamed, "A Compact Dual–Broadband Microstrip Antenna Having Both Stacked and Planar Parasitic Elements," IEEE Antennas and Propagation Society International Symposium 1996 Digest, Jul. 21–26, 1996, pp. 6–9.

International Search Report from the corresponding PCT patent application dated Dec. 17, 2001 (2 pgs.).

* cited by examiner

DUAL-BAND DUAL-POLARIZED ANTENNA ARRAY

This application is a continuation of international application number PCT EP01/04288 filed Apr. 16, 2001.

OBJECT OF THE INVENTION

The present invention refers generally to a new family of antenna arrays that are able to operate simultaneously at two different frequency bands, while featuring dual-polarization at both bands. The design is suitable for applications where the two bands are centered at two frequencies f1 and f2 such that the ratio between the larger frequency (f2) to the smaller frequency (f1) is f2/f1<1.5. The dual-band dual-polarization feature is achieved mainly by means of the physical position of the antenna elements within the array. Also, some particular antenna elements are newly disclosed to enhance the antenna performance.

BACKGROUND OF THE INVENTION

The development of dual-band dual-polarization arrays is of most interest in for instance cellular telecommunication services. Both second generation (2G) cellular services, such as the European GSM900, GSM1800 and the American AMPS and PCS1900, and third generation (3G) cellular services (such as UMTS) take advantage of polarization diversity in their network of base station possible the size of the antenna installation. Keeping a minimum size for the antenna set-up in a BTS becomes a major issue when taking into account that the growth on the service demands forces operators in increasing the number of BTS, which is starting to produce a significant visual and environmental impact on urban and rural landscapes. The problem becomes particularly significant when the operator has to provide both 2G and 3G services, because since both kinds of services operate at different frequency bands the deployment of both networks using conventional single-band antennas implies doubling the number of installed antennas and increasing the environmental impact of the installation. Therefore, the invention of dual-band dual-polarization antennas, which are able to cope simultaneously with two services at two different bands, appears as a most interesting issue.

The development of multiband antennas and antenna arrays is one of the main engineering challenges in the antenna field. There is a well-known principle in the state of the art that states the behavior of an antenna or antenna array is fully dependent on its size and geometry relative to the operating wavelength. The size of an antenna is fully dependent on the wavelength, and in an antenna array, the spacing between elements is usually fixed and keeps a certain proportion with respect to the wavelength (typically between a half and a full wavelength). Due to this very simple principle, it is very difficult to make an array to operate simultaneously at two different frequencies or wavelengths, because is difficult to make the antenna element geometry to match in size two different wavelengths and similarly, it is difficult to find an spatial arranging of the antenna elements that meets the constraints of both wavelengths at the same time.

The first descriptions of the behavior of antenna arrays were developed by Shelkunoff (S. A. Schellkunhoff, "A Mathematical Theory of Linear Arrays," Bell System Technical Journal, 22, 80). That work was oriented to single-band antennas. Some first designs of frequency independent arrays (the log-periodic dipole arrays or LPDA) were developed in the 1960's (V. H. Rumsey, *Frequency-Independent Antennas*. New York Academic, 1966; R. L. Carrel, "Analysis and design of the log-periodic dipole array," Tech. Rep. 52, Univ. Illinois Antenna Lab., Contract AF33(616)-6079, October 1961; P. E. Mayes, "Frequency Independent Antennas and Broad-Band Derivatives Thereof", Proc. IEEE, vol. 80, no. 1, January 1992). Said LPDA arrays where based on a non-uniform spacing of dipole elements of different sizes and were designed to cover a wide range of frequencies, however due their moderate gain (10 dBi) these designs have a restricted range of application and would not be suitable for applications such as for instance cellular services, where a higher gain (above 16 dBi) is required. Also, neither the horizontal beamwidth (too narrow for BTS) nor the polarization and mechanical structure of said LPDA antennas match the requirements for BTS.

Recently some examples of multiband antenna arrays have been described in the state of the art. For instance patent PCT/ES99/00343 describes an interleaved antenna element configuration for general-purpose multiband arrays. A co-linear set-up of antenna elements is described there, where the use of multi-band antenna elements is required at those positions where antenna elements from different bands overlap. The general scope of that patent does not match the requirements of some particular applications. For instance it is difficult to achieve a dual-band behavior following the description of PCT/ES99/00343 when the frequency ratio between bands is below 1.5, as it is intended for the designs disclosed in the present invention. Also, that solution is not necessarily cost-effective when an independent electrical down-tilt is required for each band. The present invention discloses a completely different solution based on dual-polarization single-band antenna elements, which are spatially arranged to minimize the antenna size.

There are already existing examples of dual-band dual-polarization antennas in the market which handle simultaneously 2G and 3G services, however these are the so called 'side-by-side' solutions which simply integrate two separate antennas into a single ground-plane and radome (FIG. 1). The inconvenient of these antenna configurations are the size of the whole package (with up to 30 cm wide they are typically twice as much the size of a single antenna) and the pattern distortion due to the coupling between antennas. Some examples of this solutions can be found for instance in http://www.racal-antennas.com/ and in http://www.rymsa.com/. The present invention discloses a more compact solution which is achieved by means of a careful selection of the antenna element positions and the shape of said antenna elements which minimizes the coupling between them.

For the particular case where the spacing between f1 and f2 is very small, several broadband solutions are described in the prior art to operate simultaneously at both bands. However, such solutions are not suitable if an independent and different down-tilt is required for each band, which is something that can be easily solved according to the present invention.

SUMMARY OF THE INVENTION

The antenna architecture consists on an interleaving of two independent vertically linear single-band arrays such that the relative position of the elements minimizes the coupling between antennas. Said spatial arranging of the antenna elements contributes to keeping the antenna size reduced to a minimum extent. In an scheme of the basic layout for the spatial arranging (interleaving) of the antenna, solid dots display the positions of the elements for the lower frequency f1, while the squares display the positions for the antenna elements for the upper frequency f2. Antenna elements for the higher frequency band f2 are aligned along a vertical axis with the desired spacing between elements. Said spacing is slightly smaller than a full-wavelength (typically below 98% the size of the shorter wavelength) for a maximum gain, although it can be readily seen that the spacing can be made shorter depending on the application.

A second vertical column of elements for the lower frequency band f1 is aligned along a second vertical axis placed next to said first axis and substantially parallel to it. In another particular arrangement of the invention, low-frequency elements are placed along a left axis while high-frequency elements are place along a right axis, but obviously the position of both axes could be exchanged such that low-frequency elements would be place on the right side and vice versa. In any case, the spacing between said axis is chosen to fall between 0.1 and 1.2 times the longer wavelength.

The shorter wavelength (corresponding to f2) determines the spacing between elements (11) at both axis. Usually a spacing below a 98% of said shorter wavelength is preferred to maximize gain while preventing the introduction of grating lobes in the upper band; this is possible due to the spacing between frequency bands which is always $f2/f1<1.5$ according to the present invention.

Regarding the relative position of elements, elements for f2 are placed at certain positions along a vertical axis and horizontal axes such that the horizontal axes intersect both with the positions of said elements and the mid-point between elements at the neighbor axis; this ensures a maximum distance between elements and therefore a minimum coupling between elements of different bands.

Having independent elements for each band, the array is easily fed by means of two-separate distribution networks. Corporate feed or taper networks in microstrip, strip-line, coaxial or any other conventional microwave network architecture described in the prior art can be used and do not constitute an characterizing part of the invention. It is interesting however to point out that by using independent networks an independent phasing of the elements at each band can be used within the present invention, which is in turn useful for introducing either a fix or adjustable electrical down-tilt of the radiation pattern at each band independently. Optionally and depending on the particular set of frequencies of f1 and f2, it is clear to those skilled in the art that any other dual-band or broad-band feeding network described in the prior art can be also used within the spirit of the present invention.

Regarding the antenna elements, any dual-polarized antenna elements (for instance crossed dipole elements, patch elements) can be used according to the scope of the present invention, however a radiating element of reduced size is preferred to reduce the coupling between them The same basic configuration of dual-band array described here features different beam widths and shapes in the horizontal plane depending on the spacing between elements in the horizontal direction. For this purpose, several elements within the array can be placed at a shifted horizontal position with respect to either left or right axis according to the present invention. Typically, the shift with respect to said axis is smaller than 70% of the longer operating wavelength. A particular case of such a displacement consists on tilting a few degrees (always below 45°) one or both of said reference axis such that the displacement is uniformly increased either upwards or downwards.

DETAILED DESCRIPTION OF A PREFERRED EMBODIMENT OF THE INVENTION

Figure 2:
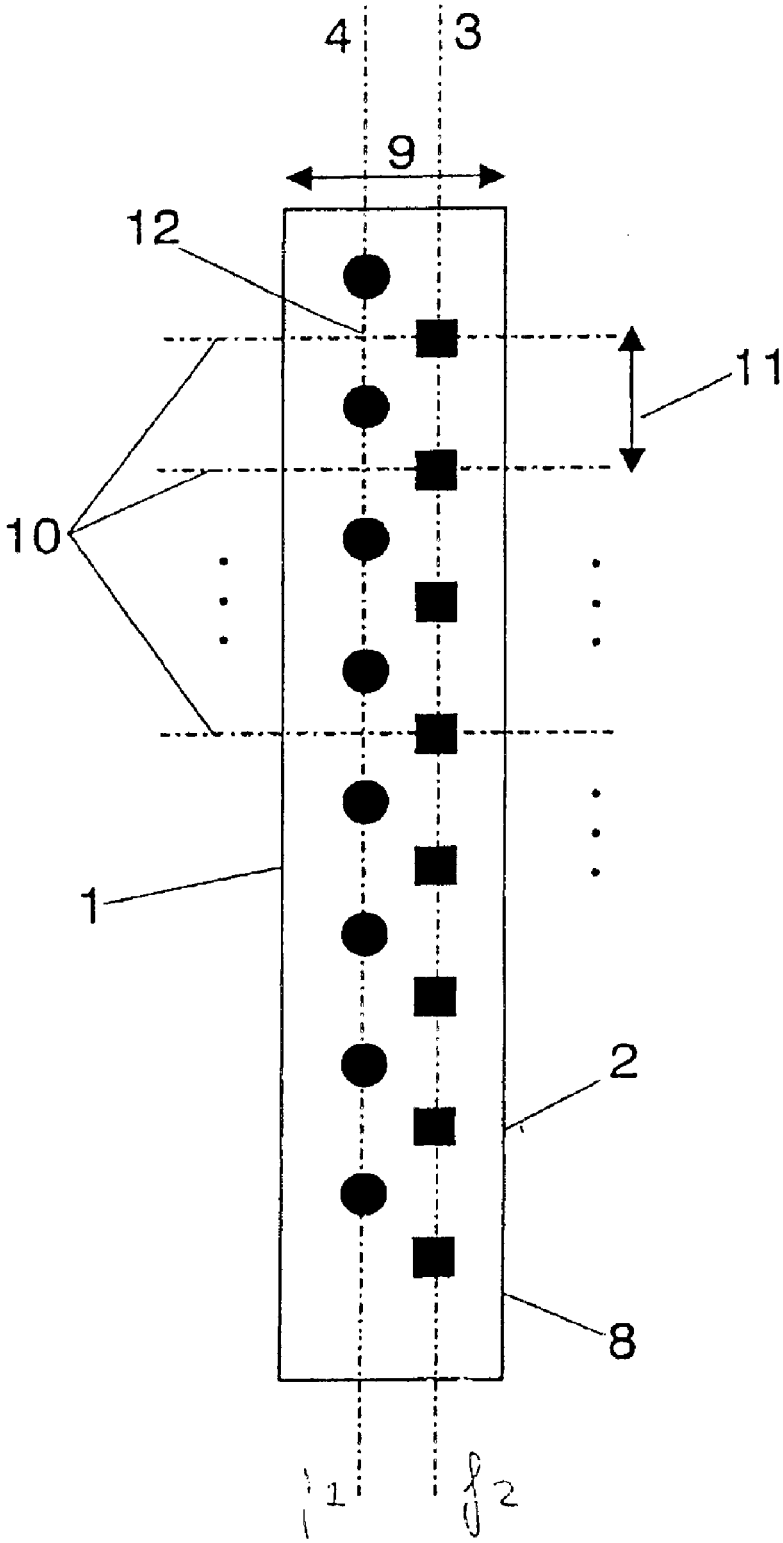
FIG. 2.—shows a general spatial arranging of the antenna elements for the dual-band dual-polarization array. The solid dots (1) display the positions of the elements for the lower frequency f1, while the squares (2) display the positions for the antenna elements for the upper frequency f2. Elements are aligned along parallel axes (3) and (4). The spacing (11) between elements in the vertical position is the same at both bands. Notice that the horizontal axes (10) that define together with axis (3) the position (2) of the elements at frequency f2, are intersecting axis (4) at the mid-point between positions (1) for elements at frequency f1. The interleaved position in the vertical axis ensures minimum coupling between bands while keeping the width (9) of the ground-plane (8) and antenna package to the minimum extent.

An scheme of the basic layout for the spatial arranging (interleaving) of the antenna elements is shown in FIG. 2. The solid dots (1) display the positions of the elements for the lower frequency f1, while the squares (2) display the positions for the antenna elements for the upper frequency f2. Antenna elements for the higher frequency band f2 are aligned along a vertical axis (3) with the desired spacing between elements (11). Said spacing is slightly smaller than a full-wavelength (typically below 98% the size of the shorter wavelength) for a maximum gain, although it can be readily seen that the spacing can be made shorter depending on the application. A second vertical column of elements for the lower frequency band f1 is aligned along a second vertical axis (4) placed next to said first axis (3) and substantially parallel to it. In the particular arrangement of FIG. 2 low-frequency elements are placed along the left axis (4) while high-frequency elements are place along the right axis (3), but obviously the position of both axes could be exchanged such that low-frequency elements would be place on the right side and vice versa. In any case, the spacing (9) between said axis (3) and (4) is chosen to fall between 0.1 and 1.2 times the longer wavelength.

The shorter wavelength (corresponding to f2) determines the spacing between elements (11) at both axis. Usually a spacing below a 98% of said shorter wavelength is preferred to maximize gain while preventing the introduction of grating lobes in the upper band; this is possible due to the spacing between frequency bands which is always f2/f1<1.5 according to the present invention. Regarding the relative position of elements (1) and (2), elements for f2 are placed at positions (2) along vertical axis (3) and horizontal axes (10) such that the horizontal axes (10) intersect both with the positions of said elements (2) and the mid-point (12) between elements (1) at the neighbor axis (4); this ensures a maximum distance between elements and therefore a minimum coupling between elements of different bands.

Having independent elements for each band, the array is easily fed by means of two-separate distribution networks. Corporate feed or taper networks in microstrip, strip-line, coaxial or any other conventional microwave network architecture described in the prior art can be used and do not constitute an characterizing part of the invention. It is interesting however to point out that by using independent networks an independent phasing of the elements at each band can be used within the present invention, which is in turn useful for introducing either a fix or adjustable electrical down-tilt of the radiation pattern at each band independently.

Optionally and depending on the particular set of frequencies of f1 and f2, it is clear to those skilled in the art that any other dual-band or broad-band feeding network described in the prior art can be also used within the spirit of the present invention.

Figure 3:
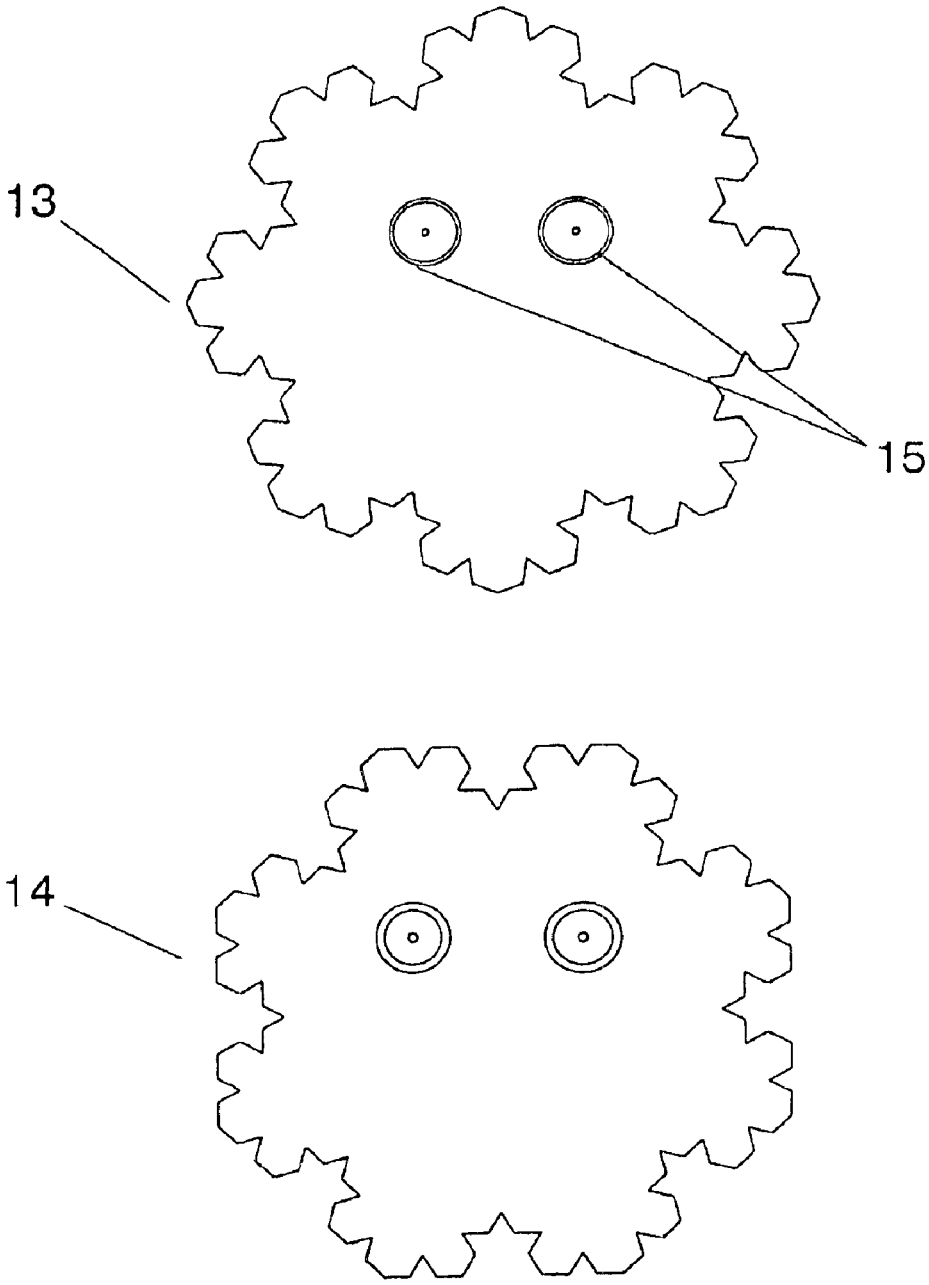
FIG. 3.—shows two particular examples (13) and (14) of dual-polarization space-filling miniature patch antennas that can be used to minimize the inter-band and intra-band coupling within the elements of the array. The white circles (15) with the inner central dot indicate the feed positions for dual orthogonal polarization.

Regarding the antenna elements, any dual-polarized antenna elements (for instance crossed dipole elements, patch elements) can be used according to the scope of the present invention, however a radiating element of reduced size is preferred to reduce the coupling between them. A small dual-polarized patch element with a space-filling perimeter is proposed here as a particular example for a possible array implementation (FIG. 3). For the same purpose, other dual-polarized space-filling miniature antenna elements, such as for instance those described in patent PCT/EP00/00411, can be used as well.

Figure 4:
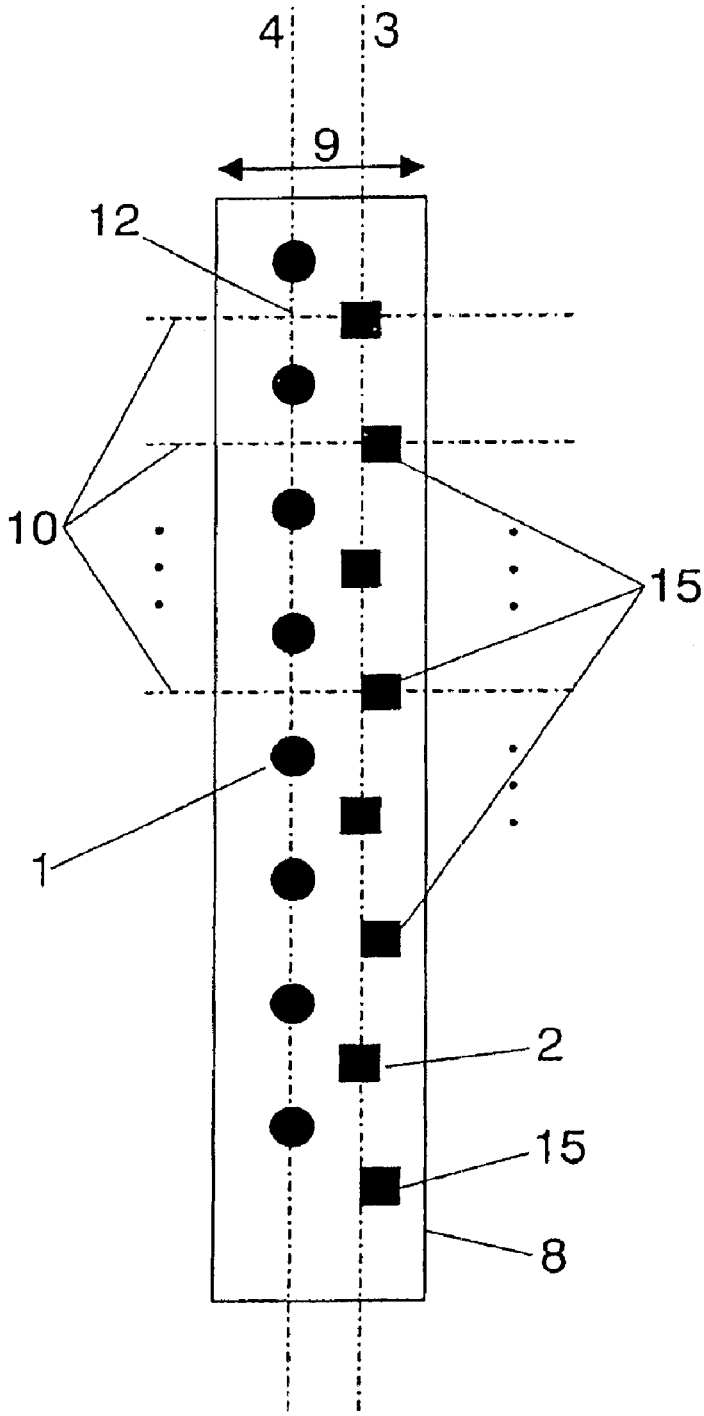
FIG. 4.—shows an example where some elements (15) are shifted horizontally with respect to the vertical axis.
Figure 5:
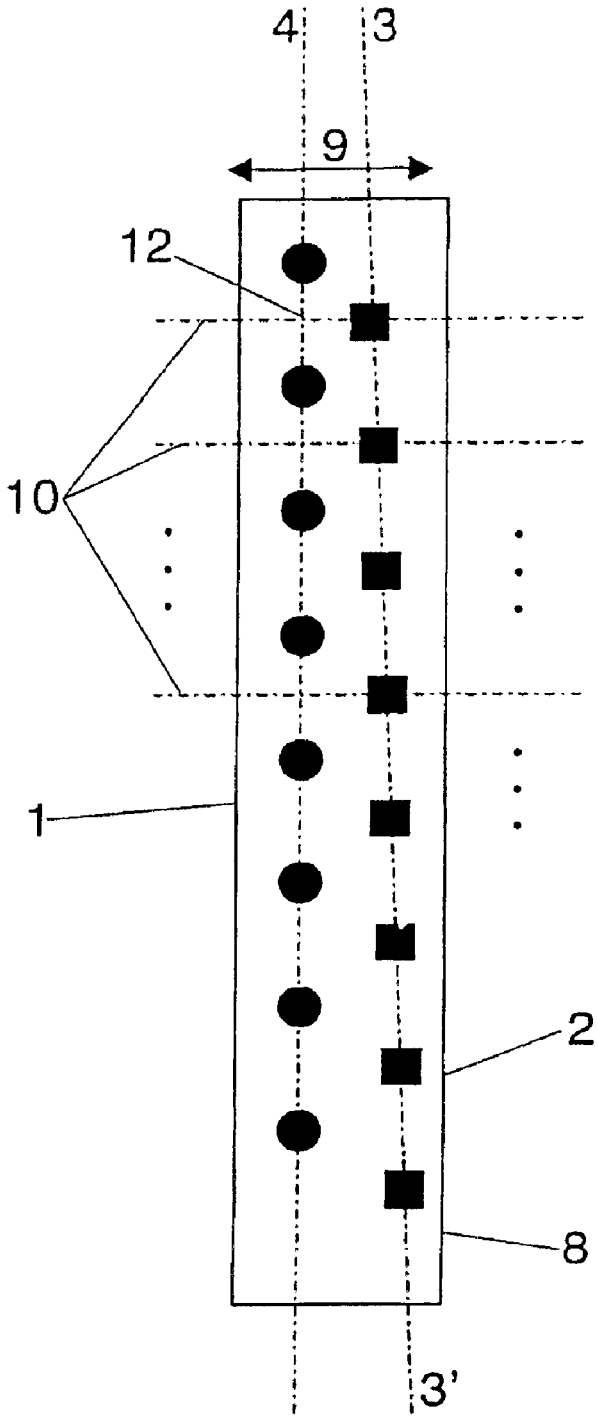
FIG. 5.—shows an example where one of the axis (3) is slightly tilted from the vertical position defining another axis (3') the elements (2) corresponding to f2 are aligned along. This can be seen as a particular case of the general one described in FIG. 4 where all the elements are sequentially displaced a fixed distance with respect to the upper neighbor.

The same basic configuration of dual-band array described here features different beam widths and shapes in the horizontal plane depending on the spacing between elements in the horizontal direction. For this purpose, several elements within the array can be placed at a shifted horizontal position with respect to either axis (3) or (4) according to the present invention. Typically, the shift with respect to said axis (3) or (4) is smaller than 70% of the longer operating wavelength. A particular case of such a displacement consists on tilting a few degrees (always below 45°) one or both of said reference axis such that the displacement is uniformly increased either upwards or downwards. FIG. 4 shows as an example a particular embodiment where the some elements are displaced from the axis, while FIG. 5 shows another embodiment where the axis (3) and (4) are slightly tilted. As it would be obvious to those skilled in the art, other shifting and tilting schemes can be used for the same purpose within the scope of the present invention.

As it can be readily seen by anyone skilled in the art, the number of elements and the vertical extent of the array is not a substantial part of the invention; any number of elements can be chosen depending on the desired gain and directivity of the array. Also, the number of elements and vertical extent of the array does not need to be the same; any combination in the number of elements or vertical extent for each band can be optionally chosen within the spirit of the present invention.

Beyond the specific coordinate position of the elements, the skilled person will notice that any rotation of the elements to for instance obtain other kind of polarizations states or changes in the antenna parameters as described in the prior art can be also applied to the present invention.

Figure 6:
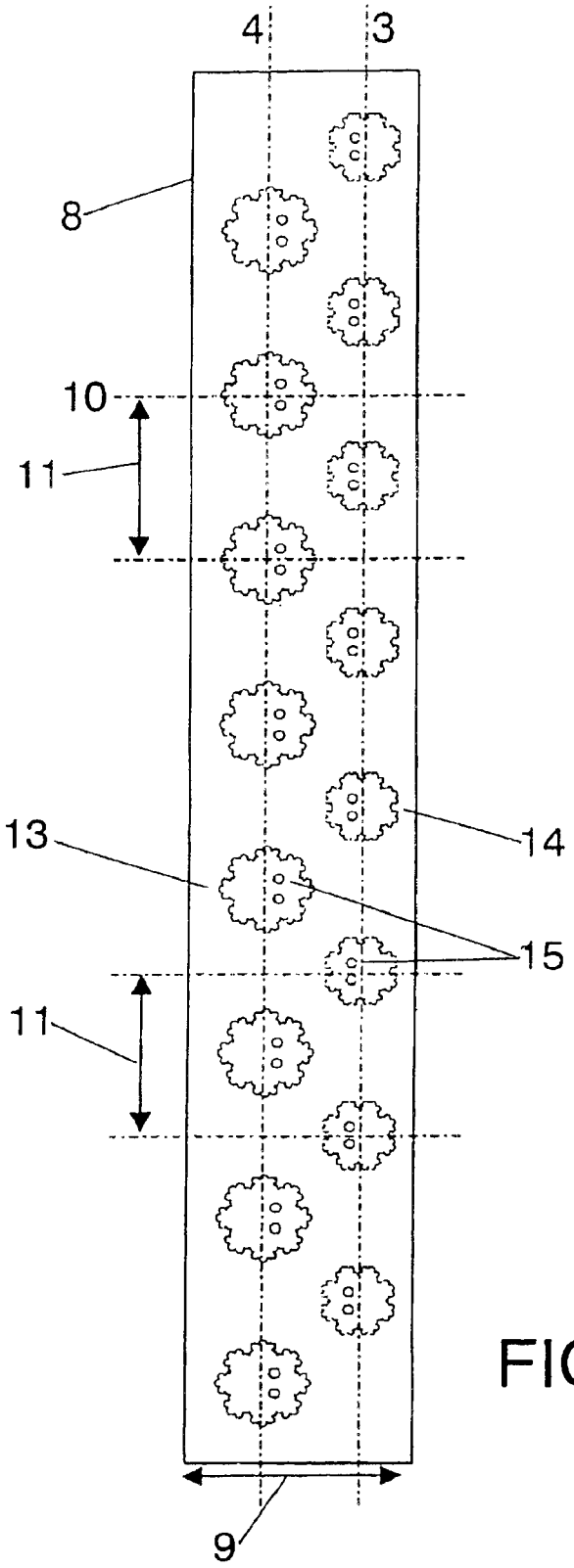
FIG. 6.—shows a preferred embodiment of a dual-polarization dual-band array for simultaneous operation at GSM1800 (1710–1880 MHz) and UMTS (1900 MHz–2170 MHz). The antenna elements are dual-polarization patches with a space-filling perimeter as those described in FIG. 3.

A preferred embodiment of the present invention is an array that operates simultaneously at the GSM1800 (1710–1880 MHz) and UMTS (1900–2170 MHz) frequency bands. The antenna features ±45° dual-polarization at both bands and finds major application in cellular base stations (BTS) where both services are to be combined into a single site. The basic configuration of a particular embodiment for such a configuration is shown in FIG. 6.

The antenna is designed with 8 elements operating at GSM1800 (13) and 8 elements operating at UMTS (14) to provide a directivity above 17 dBi. The elements are aligned along two different axes (3) and (4), one for each band. According to the present invention, elements (13) for GSM1800 are interleaved in the vertical direction with respect to elements for UMTS (14) to reduce the coupling between elements by maximizing the distance between them, yet keeping a minimum distance between said axes (3) and (4). For this particular embodiment, the spacing between axes (3) and (4) must be larger than 40 mm if an isolation between input ports above 30 dB (as usual for cellular systems) is desired.

Depending on the required gain, it is clear to anyone skilled in the art that the number of elements can be enlarged or reduced beyond 8. The number of elements can be even different for each band to achieve different gains. To operate at this particular bands, the vertical spacing between elements must be chosen to fall within the range of 100 mm to 165 mm. For an 8-element array and a gain around 17 dBi the elements are mounted upon a substantially rectangular ground-plane (8) with an overall height within a range of 1100 mm up to 1500 mm.

Figure 1:
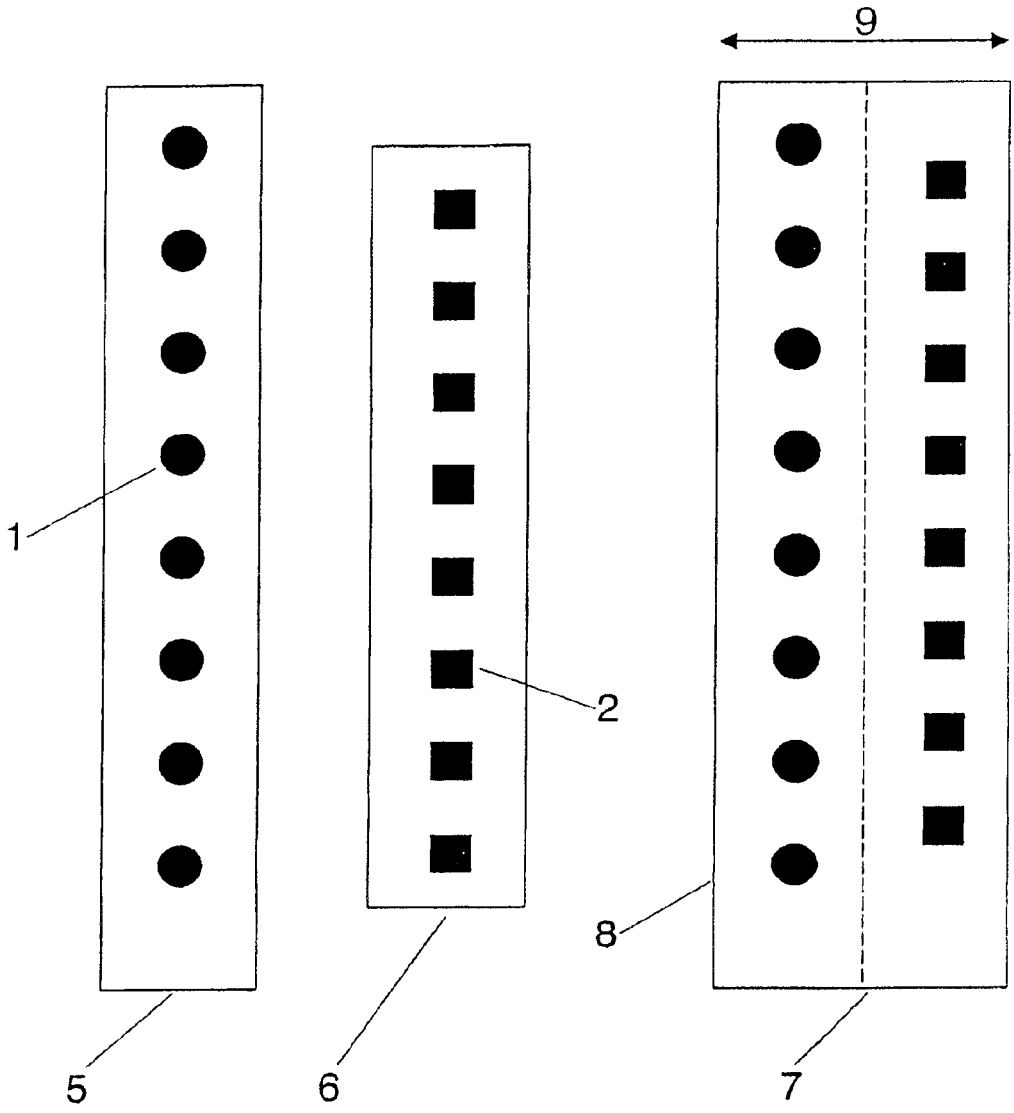
FIG. 1.—shows a conventional side-by-side solution (7) for a dual-band 2G+3G array (prior-art). Two conventional single band arrays (5) and (6) for each band are merged within a single ground-plane (8) and housed into a single radome. The horizontal width (9) of the resulting antenna system is inconvenient for aesthetical and environmental reasons. Notice that the spacing between elements at each particular bands (between dots and squares) is different for this prior art configuration.

Any kind dual-polarized single-band radiating elements can be used for this antenna array within the scope of the present invention, such as for instance crossed dipoles or circular, squared or octagonal patches, however innovative space-filling patches such as those in drawings (13) and (14) are preferred here because they feature a smaller size (height, width, area) compared to other prior art geometries. Said space-filling patches can be manufactured using any kind of the well-known conventional techniques for microstrip patch antennas and for instance can be printed over, a dielectric substrate such as epoxy glass-fiber (FR4) substrates or other specialized microwave substrates such as CuClad®, Arlon® or Rogers® to name a few. Said elements are mounted parallel to a conducting ground-plane (8) and typically supported with a dielectric spacer. It is precisely the combination of the particular spatial arrangement of the elements (vertical interleaving and proximity of vertical axis) together with the reduced size and the space-filling shape of the patch antenna elements that the whole antenna size is reduced. The size of the antenna is basically the size of the ground-plane (8) which for this particular embodiment must be wider than 140 mm but it can be typically stretched below 200 mm, which is a major advantage for a minimum visual environmental impact on landscapes compared to other conventional solutions such as the one described in FIG. 1

The elements can be fed at the two orthogonal polarization feeding points located at the center of the circles (15) by means of several of the prior-art techniques for patch antennas, such as for instance a coaxial probe, a microstrip line under the patch or a slot on the ground-plane (8) coupled with a distribution network beyond said ground-plane. For a dual-band dual-polarization operation four independent feeding and distribution networks (one for each band and polarization) can be used. According to the preferred embodiment, said feeding networks are mounted on the back-side of the ground-plane and any of the well-known configurations for array networks such as for instance microstrip, coaxial or strip-line networks can be used since does not constitute an essential part of the invention.

Regarding the relative position of the feeding points (15) upon the patch, FIG. 6 shows an embodiment where said feeding points are located at the inner side towards the center of the ground-plane, that is, at the right side of axis (4) for the lower band and at the left side of axis (3). Those skilled in the art will notice that any other embodiments can be used as well within the scope of the present invention, such as for instance: all elements with feeding points at the left part of their respective axes, all feeding points on the right side, some elements on the right side and some on the left side, or even some elements with a feeding point at each side of the corresponding axis is possible within the scope of the present invention.

In the preferred embodiment, the overall antenna array with the elements, ground-plane and feeding network is mounted upon a conventional shielding metallic housing enclosing the back part of the ground-plane, said housing also acting for a support of the whole antenna. Also, a conventional dielectric radome covering the radiating elements and protecting the whole antenna from weather conditions is also mounted and fixed to the housing as in any conventional base-station antenna.

The antenna would naturally include 4 connectors (typically 7/16 connectors), one for each band and polarization, mounted at the bottom part of the ground-plane. Each connector is then been connected through a transmission line (such as for instance a coaxial cable) to the input port of each feeding network.

The skilled in the art will notice that other connector combinations are possible within the scope of the present invention. For instance, a filter duplexer can be used to combine the input ports of the +45° GSM1800 and UMTS networks into a single connector, and the −45° GSM1800 and UMTS networks into another single connector to yield a total of only two connectors. Said duplexer can be any duplexer with a 30 dB isolation between ports and does not constitute an essential part of the present invention. Obviously, and alternative solution such as a broadband or dual-band network combining GSM1800 and UMTS for the +45° and another one for the −45° polarization could be used instead of the diplexer, which yields to a two-connector configuration as well.

Having illustrated and described the principles of our invention in several preferred embodiments thereof, it should be readily apparent to those skilled in the art that the invention can be modified in arrangement and detail without departing from such principles.

What is claimed is:

1. Dual-band dual-polarized antenna array operating at a lower frequency f1 and at a higher frequency f2, the ratio f2/f1 being smaller than 1.5, wherein the antenna elements are arranged as follows:

(a) a first row of antenna elements aligned along a first vertical axis, said first row of antenna elements being dual-polarized antenna elements operating at said higher frequency f2, the spacing between said elements being smaller than the size of the central wavelength at said higher frequency f2

(b) a second row of antenna elements aligned along a second vertical axis, said second row of antenna elements being dual-polarized antenna elements operating at said lower frequency f1, said second row of antenna elements being spaced the same distance as said first row of antenna elements in the adjacent row operating at frequency f2, said second vertical axis located substantially parallel to said first vertical axis at a distance between 0.1 and 1.2 times the longer operating wavelength, and wherein the positions of said first row of antenna elements operating at frequency f2 are interleaved in the vertical direction with respect to the vertical positions of said second row of antenna elements operating at frequency f1 so that the distance among elements is maximized.

2. Dual-band dual-polarized antenna array according to claim 1 wherein at least one element operating at either of the two frequencies f1 and f2 is shifted horizontally from its corresponding vertical axis at a distance smaller than a 70% of the longer operating wavelength.

3. Dual-band dual-polarized antenna array according to claim 1 or 2 wherein at least one of said two axes is tilted at an angle smaller than 45° with respect to the vertical direction.

4. Dual-band dual-polarized antenna array according to claim 1 or 2 wherein the size of the resonant antenna elements is smaller than one half of the free-space operating wavelength.

5. Dual-band dual-polarized antenna array according to claim 1 or 2 wherein the antenna elements are space-filling antennas.

6. Dual-band dual-polarized antenna array according to claim 1 or 2 wherein the antenna elements comprise at least a micro-strip patch element with a space-filling perimeter.

7. Dual-band dual-polarized antenna array according to claim 1 or 2 wherein the operating frequencies f1 and f2 are selected from the group consisting of the GSM1800 (1710–1880 MHz) and UMTS (1900–2170 MHz) frequency bands, wherein the spacing between elements at each of said vertical axes is chosen between 100 mm and 165 mm, wherein the spacing between said two vertical axes is at least 40 mm and wherein the antenna elements are mounted upon a substantially rectangular conducting ground-plane, said ground-plane being at least 140 mm wide in the horizontal direction.

8. Dual-band dual-polarized antenna array according to claim 1 or 2 wherein the operating frequencies f1 and f2 are selected from the group of bands consisting of: GSM1800 or DCS (1710–1880MHz); UMTS (1900–2170 MHz), PCS1900 (1850–1990 MHz) and DECT (1880–1900) or any combination thereof.

9. Dual-band dual-polarized antenna according to claim 7, wherein the antenna features a different electrical down-tilt at each of the two bands and wherein the antenna is used in a base-station of a cellular system network to provide coverage in said two bands.

10. Dual-band dual-polarized antenna array according to claim 1 or 2 wherein the operating frequencies f1 and f2 are selected from the group of bands consisting of: GSM900 (890–960 MHz); U.S. Cellular/Qualcomm-CDMA (824–894 MHz); TACS/ETACS (870–960); ID54 (824–894MHz); CT2 (864–868 MHz) and any combination thereof.

11. Dual-band dual-polarized antenna array according to claim 1 or 2 wherein the spacing between elements at said first frequency f1 can differ from the spacing between elements at second frequency f2 up to 20%.

* * * * *

UNITED STATES PATENT AND TRADEMARK OFFICE

CERTIFICATE OF CORRECTION

PATENT NO. : 6,937,206 B2
DATED : August 30, 2005
INVENTOR(S) : Carles Puente et al.

It is certified that error appears in the above-identified patent and that said Letters Patent is hereby corrected as shown below:

Column 1,
Line 27, replace "of base station possible" with -- of base station (BTS) antennas to enhance the service performance while reducing as much as possible --.

Column 6,
Line 48, replace "printed over, a" with -- printed over a --.

Signed and Sealed this

Twenty-first Day of March, 2006

JON W. DUDAS
*Director of the United States Patent and Trademark Office*